US006042735A

United States Patent [19]

Gommel et al.

[11] Patent Number: 6,042,735

[45] Date of Patent: Mar. 28, 2000

[54] PROCESS AND DEVICE TO DRAIN A FIBROUS PULP SUSPENSION

[75] Inventors: Axel Gommel; Herbert Holik, both of Ravensburg; Josef Schneid, Vogt, all of Germany

[73] Assignee: Voith Sulzer Stoffaufbereitung GmbH, Ravensburg, Germany

[21] Appl. No.: 08/921,023

[22] Filed: Aug. 29, 1997

[30] Foreign Application Priority Data

Aug. 30, 1996 [DE] Germany ..... 196 35 202

[51] Int. Cl.[7] ..... B01D 37/00; B01D 33/044; B01D 33/048

[52] U.S. Cl. ..... 210/770; 210/780; 210/784; 210/783; 210/785; 210/388; 210/400; 210/402; 210/248; 100/37; 100/116; 100/118; 100/121; 100/151; 100/153; 162/56

[58] Field of Search ..... 210/784, 770, 210/785, 783, 383, 384, 388, 400, 402, 248; 100/37, 116, 118, 121, 151, 153; 162/56, 100, 189, 358.1, 358.4, 368, 373

[56] References Cited

U.S. PATENT DOCUMENTS 50,158 9/1865 Pool et al. .

838,615 12/1906 Goldman .

1,595,894 8/1926 Klund .

2,365,658 12/1944 Schumacher .

3,878,698 4/1975 Friksson et al. .

*Primary Examiner*—Robert Popovics

*Attorney, Agent, or Firm*—Greenblum & Bernstein, P.L.C.

[57] ABSTRACT

Process and device for draining a fibrous pulp suspension. The process may include positioning two surfaces to converge in a downstream direction, feeding the fibrous pulp suspension between the two converging surfaces, driving at least one of the two converging surfaces to move the suspension with a relative translational velocity, and draining the fibrous pulp suspension through each of the two surfaces. The device may include two arcuate surfaces positioned to form converging surfaces. One of the two arcuate surfaces may include a drivable, pivotable, and rotatable cylinder having an outer sleeve with openings, the other of the two arcuate surfaces may include a screen positioned to be guided around at least a portion of the outer sleeve. The screen and the openings may form drains for draining the fluid pulp suspension.

12 Claims, 4 Drawing Sheets

PROCESS AND DEVICE TO DRAIN A FIBROUS PULP SUSPENSION

CROSS-REFERENCE TO RELATED APPLICATION

The present application claims priority under 35 U.S.C. §119 of German Patent Application No. 196 35 202.9 filed Aug. 30, 1996, the disclosure of which is expressly incorporated by reference herein in its entirety.

BACKGROUND OF THE INVENTION

1. Field of the Invention

The present invention relates to a process to drain a fibrous pulp suspension that includes feeding a layer of suspension to be drained between two converging surfaces and relatively moving the two surfaces with respect to each other at a desired velocity. In this manner, the suspension may be drained toward both surfaces. The present invention may utilize a draining device including an inner arched surface including a pivoting cylinder having a sleeve with openings, and an outer arched surface including a screen belt guided around a portion of the inner arched surface. The pivoting cylinder may be driven. Alternatively, the screen belt may be an endless belt guided around an non-driven pivoting cylinder. Further, the inner arched surface may include a stationary arched shoe and the outer arched surface may include an endless screen belt moved around a portion of the stationary arched shoe.

2. Discussion of the Background Information

WO 96/08660 describes a device in which a process for draining a fibrous pulp suspension may be performed. This device contains a suction roll that can be driven and includes a permeable surface, a portion of its circumference being surrounded by an impermeable plastic belt. The suspension is inserted between these two surfaces and drained.

Processes of the above-type generally attempt to achieve the best possible drainage with the highest possible throughput. However, the obstacle in achieving this goal is that the impermeable belt in the first part of the draining zone only allows drainage toward one side. In this manner, a substantial vacuum is required to achieve a sufficient drainage capacity and to compensate the centrifugal forces.

Another disadvantage of the prior art is that solid matter can accumulate on the stationary and impermeable screen surface, which and can quickly lead to clumps that can seriously interfere with the proper operation of the entire device. Further, cleaning of these surfaces during operation is not possible.

SUMMARY OF THE INVENTION

The present invention provides a process, similar in general to the process described above, which achieves an efficient draining capacity and high operational reliability.

Thus, the present invention provides a process to drain a fibrous pulp suspension. The process may include feeding a layer of suspension to be drained between two converging surfaces and relatively moving the two surfaces with respect to each other at a given velocity, and draining the suspension towards both surfaces. With this process, one can already achieve a very efficient drainage in an initial drainage section, i.e. where the suspension is fed between converging surfaces. The drainage is further enhanced, as is generally known, by introducing shear forces in the fiber mat. Further, control of the draining effect may be possible by selecting a relative speed of the surfaces, as well as a speed of the supplied suspension.

The more or less dry pulp, which is extracted from the fibrous pulp suspension, may be present in the form of a sheet. In some cases, the pulp may be formed in the shape of fibrous pulp rolls, having axes extending transverse to the direction of movement of the surfaces and having a diameter of between approximately 1 mm and several millimeters.

Another advantage of the present invention is that essentially no cleaning problems are created in the area of the converging surfaces. The converging surfaces are designed to be essentially permeable and may be continuously washed off during operation. One of the converging surfaces may remain completely stationary, i.e., the surface performs no translational movement at all. Alternatively, instead of being stationary, the one converging surface may be driven at a variable speed, e.g., at a creeping speed, to even out wear and/or to perform a cleaning.

A number of alternative embodiments are possible for carrying out the process of the present invention. The relative speed between the two converging surfaces can be created in a number of ways, each way having certain unique effects on the system operation. The suspension may be conventionally fed into a draining device having one flow velocity. The low velocity, among other factors, may determine an amount of the suspension that machine may drained within a certain time period. In practice, the user may determine the speed in the direction of the flow (i.e., downstream) for at least one of the surfaces in contact with the suspension. This flow velocity substantially corresponds, generally, to the flow velocity of the suspension at the inflow location. By selecting a differential speed, possibilities to influence the draining effect of the machine arise. In this manner, the two converging surfaces move past each other at a relative velocity at which the suspension is moved. In its simplest configuration, one surface may be held stationary. However, the present invention has found certain advantages resulting from moving both surfaces, although the second surface is driven at a low velocity (i.e., creeping speed). Accordingly, a more beneficial result with respect to wear is achieved. Further, this arrangement enables the potential for cleaning both surfaces during operation. Thus, as the machine velocity increases, the second surface may be moved faster in order to maintain the desired relative velocity.

The surface with which the suspension contacts may also have an influence on the process. That is, due to the relative motion of the two contact surfaces, the suspension, located between the two surfaces, tends to create little rolls, which may be desirable. By selecting particular surfaces to use, the user may easily control the roll production so that it is, e.g., strong enough to assist the draining, but not strong enough, e.g., to create undesirable clumping or excessive wear.

The present invention is directed to a process to drain a fibrous pulp suspension. The process may include positioning two surfaces to converge in a downstream direction, feeding the fibrous pulp suspension between the two converging surfaces, driving at least one of the two converging surfaces to move the suspension with a relative translational velocity, and draining the fibrous pulp suspension through each of the two surfaces.

In accordance to another feature of the present invention, the feeding may include distributing the fibrous pulp suspension in a wide stream between the two converging surfaces at a velocity that substantially corresponds velocity of the at least one driven converging surface.

In accordance with another feature of the present invention, the process may further include exerting a pressure of at least approximately 0.01 bar on the suspension, due to screen tension, when located between the converging surfaces. The relative translational velocity may be at least approximately 18 m/min, and preferably at least approximately 50 m/min.

In accordance with a further feature of the present invention, the process may further include holding stationary at least one of the two converging surfaces.

In accordance with still another feature of the present invention, one of the converging surfaces may be smooth and the other converging surface may include a surface that increases an abrasion force in the downstream direction.

In accordance with a still further feature of the present invention, the process may further include oscillating at least a portion of the two converging surfaces relative to each other. Further, the process may include oscillating the two converging surfaces relative to each other at a plurality of locations.

In accordance with another feature of the present invention, one of the two converging surfaces may be an outer arched surface and the other of the two converging surfaces may be an inner arched surface.

In accordance with a still further feature of the present invention, one of the two converging surfaces may be an arched surface and the other of the two converging surfaces may be substantially flat.

The present invention may be directed to a draining device for draining a fibrous pulp suspension. The draining device may include two arcuate surfaces positioned to form converging surfaces. One of the two arcuate surfaces may include a drivable, pivotable, and rotatable cylinder having an outer sleeve with openings, and the other of the two arcuate surfaces may include a screen positioned to be guided around at least a portion of the outer sleeve. The screen and the openings forming drains for draining the fluid pulp suspension.

In accordance with another feature of the present invention, the openings may communicate with an interior of the cylinder.

In accordance with still another feature of the present invention, the openings may include blind holes.

In accordance with another feature of the present invention, the screen may be resistant to bending. The screen may include a joint, the joint being pivotably mounted to pivot toward the cylinder.

In accordance with a further feature of the present invention, the draining device may include an a device for exerting adjustable pressure and the screen being pressed against the cylinder by the adjustable pressure device.

In accordance with a still further feature of the present invention, the screen may include elastic. Further, the screen may be mounted to be stationary when viewed in the run direction of the cylinders. Still further, the screen may include a plurality of sections, the sections including at least one of different curvatures and different screen tensions. The plurality of sections may include a slidable dividing line separating the sections.

In accordance with another feature of the present invention, the screen may include different zone and openings in each zone, the openings in each zone being different than the openings in the other zones.

In accordance with still another feature of the present invention, the screen may include joints and the screen may include at least two pieces coupled by the joints.

In accordance with a further feature of the present invention, the draining device may include a pulp headbox to inject a wide stream of suspension to be drained between the two arcuate surfaces.

In accordance with a still further feature of the present invention, the draining device may include an arc screen positioned upstream of the two arcuate surfaces. The suspension may be pre-drained by the arc screen.

In accordance with still another feature of the present invention, the draining device may include a pulsating device coupled to create oscillating pressure impulses on at least one of the two arcuate surfaces.

In accordance with another feature of the present invention, the other of the two arcuate surfaces may provide a dewatering pressure.

In accordance with a still further feature of the present invention, the sleeve may include a porous layer providing a void volume. The openings may communicate with the porous layer, however, the porous layer does not communicate with an interior of the cylinder.

The present invention is directed to a draining device for draining a fibrous pulp suspension. The draining device may include two arcuate surfaces positioned to form converging surfaces. A first of the two arcuate surfaces may include a drivable, rotatable cylinder having an outer sleeve with through openings and a second of the two arcuate surfaces may include a screen having an endless screen to be guided around a circumferential portion of the outer sleeve. The screen may be drivable along the circumferential portion of the outer sleeve, and the screen and the openings may form drains for draining the fluid pulp suspension.

In accordance with another feature of the present invention, the draining device may further include one of a press roll and a press shoe. The one of a press roll and a press shoe may be positioned to press one of the two arcuate surfaces against the other arcuate surface. Further, the press roll may include a felted surface. Also, the press roll may be rotatably mounted to rotate in a direction counter to the surface to be pressed.

The present invention may also be directed to a draining device for draining a fibrous pulp suspension. The draining device may include a first and a second arcuate surface positioned to form converging surfaces. The first surface may include a stationary arched shoe and the second surface may include an motor driven endless screen.

In accordance with yet another feature of the present invention, the draining device may further include one of a press roll and a press shoe. The one of a press roll and a press shoe may be positioned to press one of the first and second arcuate surfaces against the other of the first and second arcuate surfaces. Further, the press roll may include a felted surface. Also, the press roll may be rotatably mounted to rotate in a direction counter to the surface to be pressed.

The present invention is directed to a draining device for draining a fibrous pulp suspension. The draining device may include a first and a second surface positioned to form converging surfaces. The first surface may include an acuate portion having a plurality of openings and the second surface may include a screen positioned along at least a portion of the arcuate portion. At least one of the first and second surface may be driven to move with respect to the other of the first and second surface and the screen and the openings may form drains for draining the fluid pulp suspension.

Other exemplary embodiments and advantages of the present invention may be ascertained by reviewing the present disclosure and the accompanying drawing figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
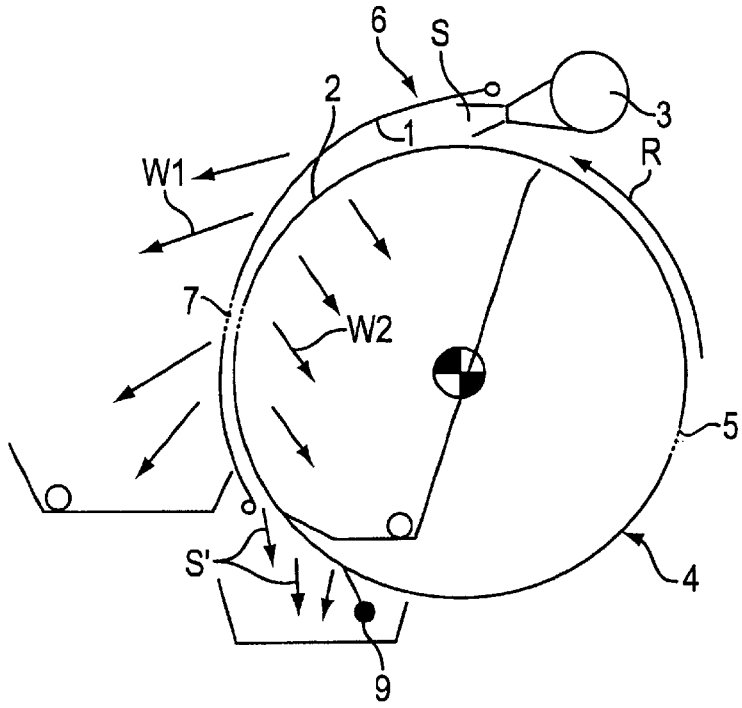
FIG. 1 illustrates a schematic view of a draining device for performing the draining process of the present invention.

FIG. 1 shows a draining device for performing the process of the present invention. As shown in FIG. 1, the draining device may include two surfaces 1 and 2 which are positioned to converge, in a direction of suspension flow, around a substantially arcuate or circular path. A first converging surface, e.g., surface 2, may be formed by an inner arched surface of, e.g., a cylinder 4. Cylinder 4 may rotate in a direction indicated by arrow R, at a velocity sufficient to move a suspension S through the converging surfaces at a velocity substantially similar to the velocity at which the suspension S exits a pulp headbox 3. A second converging surface, e.g., surface 1, may be positioned outside of inner arched surface 2 and may be formed by an outer arched surface of, e.g., a screen 6. Screen 6 may be clamped or anchored at both ends, and, therefore, may be practically stationary with respect to the neighboring circumference of cylinder 4. Both outer and inner arched surfaces 1 and 2 may be provided with openings 5 and 7, respectively. The openings depicted in FIG. 1 are exemplary only, and the specifics of the openings may be determined by the user, e.g., the openings within cylinder 4 may be blind holes or may extend into the cylinder interior. Suspension S may be fed between the inner and outer arched surfaces, which are moved relative to each other, and drained. The suspension S is moved at a predetermined or desired translational speed between the relatively moving converging surfaces. Suspension S may be drained in both directions through the openings in both the inner and outer surfaces, as indicated by arrows W1 and W2. Drained suspension S' may fall into a collection container. If necessary, drained suspension S' may be removed from the circumferential surface of cylinder 4 with a scraper 9.

Figure 2:
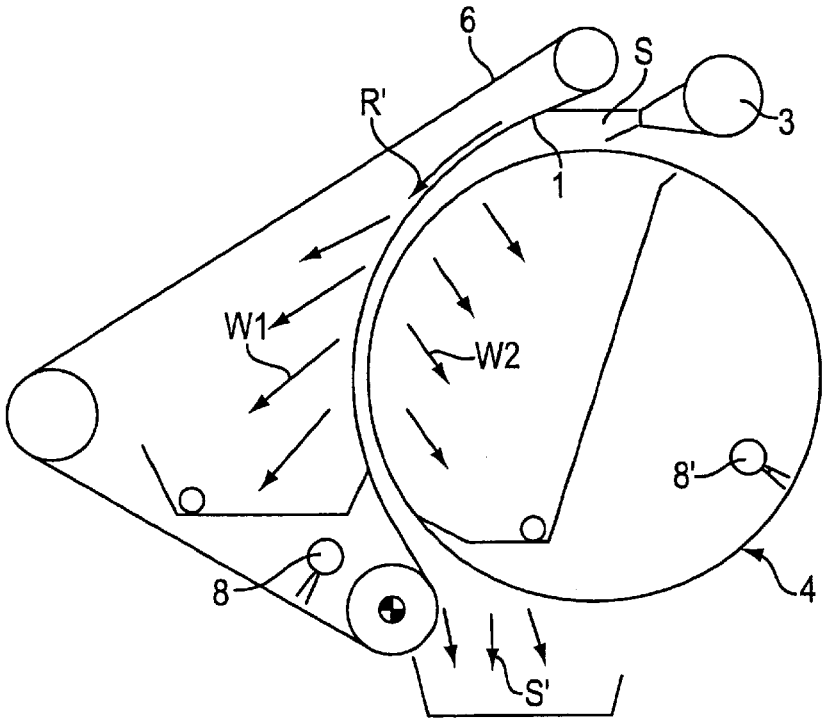
FIG. 2 illustrates an alternative draining device to the draining device depicted in FIG. 1.

FIG. 2 differs from FIG. 1 in that screen 6 may be formed as an endless loop. In accordance with this embodiment of the present invention, screen 6 may be driven to move in a direction indicated by R' as a desired speed. In accordance with this embodiment, screen 6 may be circulated at a creeping speed, i.e., substantially slower than the rotation of cylinder 4, so as to facilitate cleaning screen 6 with, e.g., a spray pipe 8, or to even out wear on the screen surface. The desired relative translational speed, i.e., the overall velocity at which the suspension S is to be moved between the converging surfaces 1 and 2 (or the speed differential between rotation of cylinder 4 and rotation of screen 6), may be selected to substantially correspond to the speed of inflowing suspension S. Further, cylinder 4 may remain stationary or may be driven to move at an adjusted speed. If cylinder 4 moves, an interior surface of cylinder 4 may be cleaned, e.g., via a spray pipe 8'. If cylinder 4 is stationary or set to a creeping speed, the speed of screen 6 may be increased to provide the desired translational movement of suspension S.

Suspension S may have a pressure of, e.g., approximately 0.1 bar, and at least 0.01 bar, exerted upon it by screen tension due to converging surfaces 1 and 2. The relative translational velocity or speed of suspension S between the converging surfaces, as noted above, may be set in accordance with the output rate of the suspension inlet, however, in accordance with the present invention, the translational velocity should be at least 18 m/min, and preferably at least 50 m/min.

Figure 3:
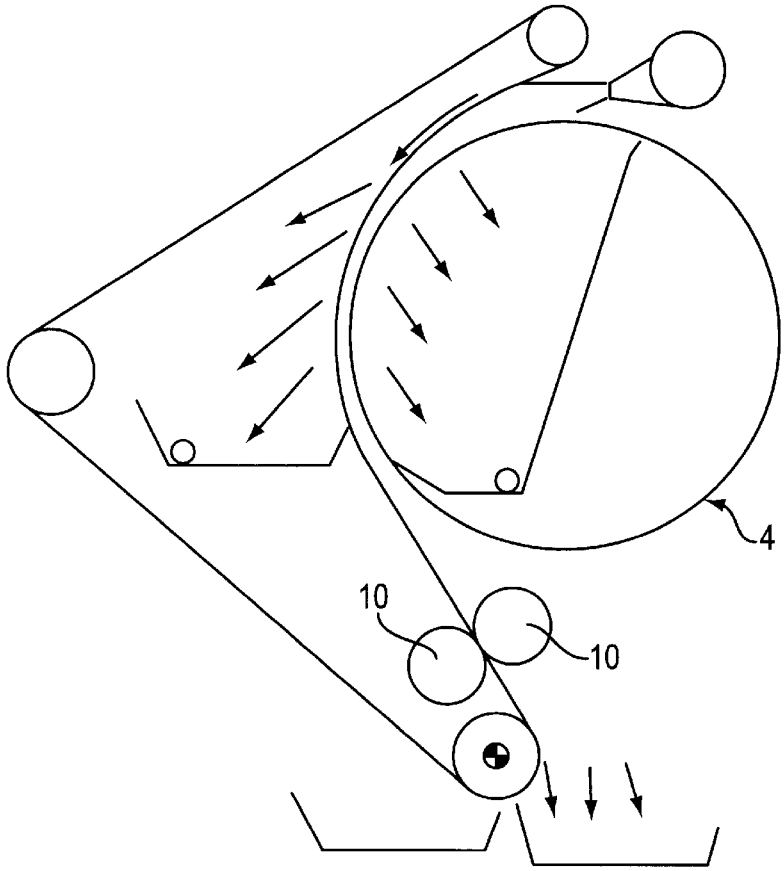
FIG. 3 illustrates another alternative draining device to the draining device depicted in FIGS. 1 and 2.

Another alternative embodiment of the device for performing the draining process of the present invention is illustrated in FIG. 3. In FIG. 3, screen 6 may be guided through two press rolls 10. The passage through press rolls 10 may further enhance the draining effect of the present invention. Further, one of the press rolls 10 may be utilized to remove the thickened pulp from the surface of screen 6. It is noted that the above-discussion with respect to the relative speeds between screen 6 and cylinder 4 in FIG. 2 are applicable with the embodiment depicted in FIG. 3.

Figure 4:
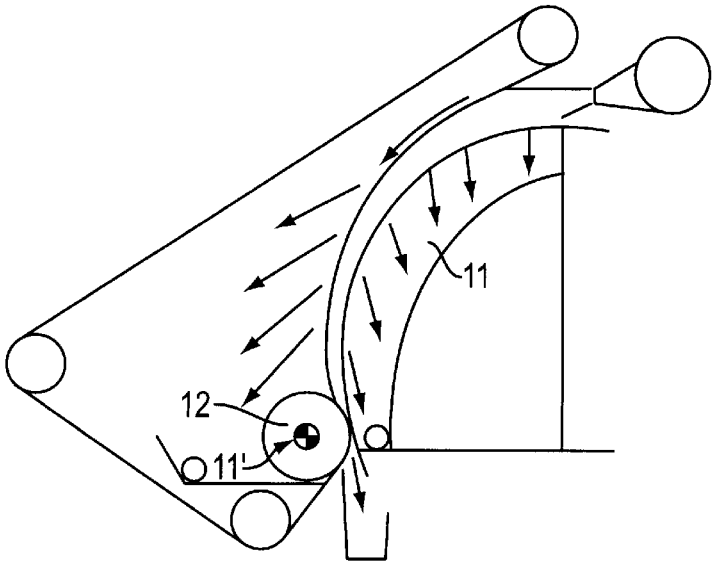
FIG. 4 illustrates an alternative draining device having an arched shoe.

FIG. 4 illustrates a further variation for the draining device of the present invention. In FIG. 4, inner arched surface 2 may be formed by an arched shoe 11. Arched shoe 11 may remain stationary in space, and, accordingly, relative translational movement between screen 6 and the outer surface of arched shoe 11 may be achieved via circulating screen 6 at the desired speed. Further, arched shoe 11 may be provided with a suction device to create a vacuum within arch shoe 11. In accordance with a further alternative to the embodiment of FIG. 4, a press roll 12 may be located to provide an additional contact pressure. Press roll 12 may be pressed against screen 6 in a direction toward arched shoe 11, as indicated by a force arrow 11' to further increase or enhance the draining capacity of the draining device. Press roll 12 may be smooth, felted, or may be provided with openings. In a further alternative, a press shoe may be utilized in place of press roll 12.

Figure 5:
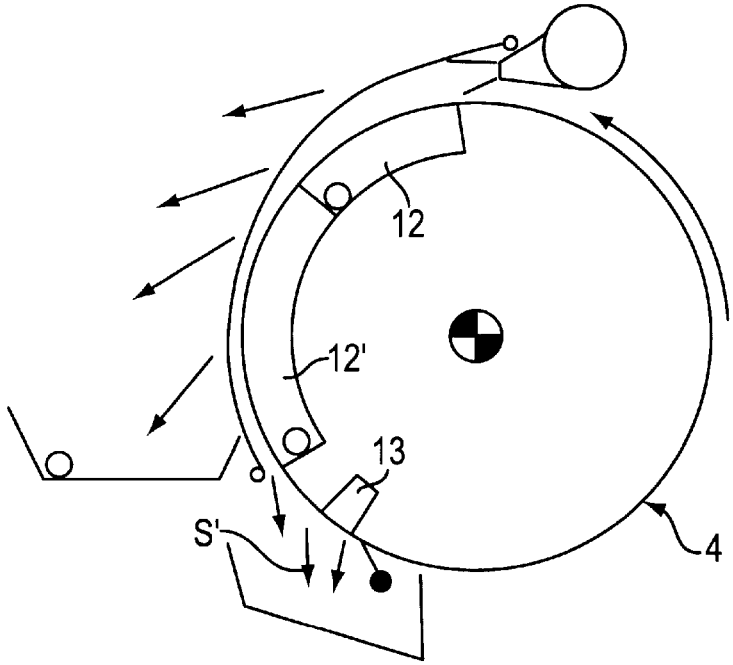
FIG. 5 illustrates an alternative draining device having a suction cylinder.

When using a cylinder as the inner arched surface, it may be further advantageous to utilize a partial vacuum within the drainage zone, as illustrated, e.g., in FIG. 5. In this embodiment, two suction chambers 12 and 12', which may be pressurized at different pressures, may be located within cylinder 4 opposite the outer arched surface. In this manner, the draining of suspension S may be enhanced by aspiration to draw additional drained fluid into cylinder 4. The specific number of chambers depends upon the requirements of the desired draining, and, therefore, the selection is left up to the expert. FIG. 5 further shows another potential feature for improving the discharging of drained suspension S'. A blow box 13 may be located within cylinder 4 downstream of the suction chambers, and substantially adjacent the scraper, to provide an over-pressure from the inside of cylinder 4 to improve the effectiveness of the scraper by blowing drained suspension S' from the outer surface of the cylinder. It is further noted that the present invention contemplates utilizing the suction chambers and/or blow box within the previously discussed embodiments, e.g., as depicted in FIGS. 3 and 4. For the sake of completeness it must be mentioned that the variation possibilities mentioned up to now in regard to the outer arched surface also exist in the embodiments shown in FIGS. 3 and 4.

Figure 6:
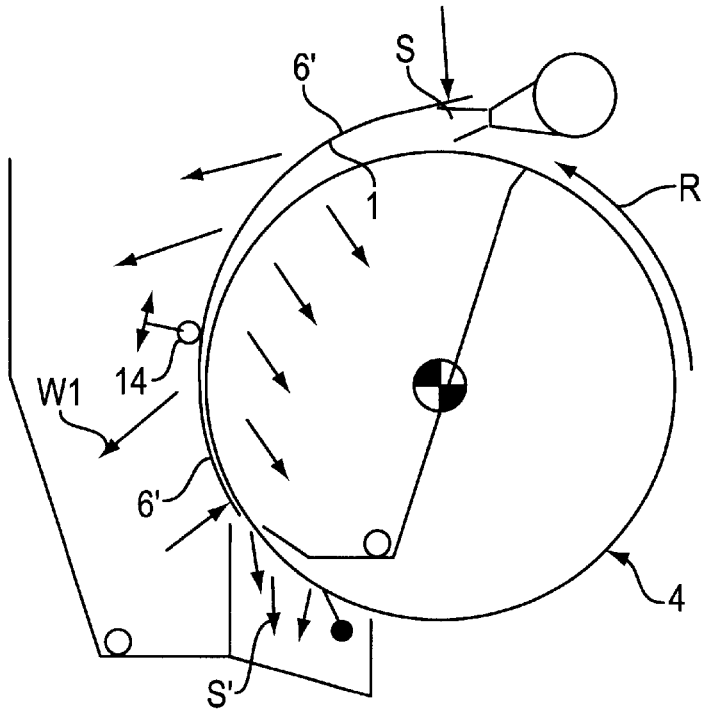
FIG. 6 illustrates a draining device having a sectioned exterior screen.

In a further advantageous alternative, the draining zone may be divided into at least two sections such that one of the arched surfaces is divided into at least two sections, each section having a different curvature and/or angle. This particular embodiment may be seen, e.g., in FIG. 6. A stiff screen forming the outer arched surface may include two sections 6' and 6" that may be coupled together by a joint 14. Joint 14 may be formed to be slidable, so that a boundary formed by sections 6' and 6" of the screen may be changed. Of course, more than two sections may be utilized in accordance with the present invention. Further, sections 6' and 6" of the screens may be formed by, e.g., elastic screens instead of the stiff screens. Elastic screens have the advantage that they may be clamped into position on one end and enable the user to select various screen tensions in accordance with the desired draining to be performed. The screens may further be coupled to a line, e.g., mounting rod, that may be held in position and that may be slidable.

Figure 7:
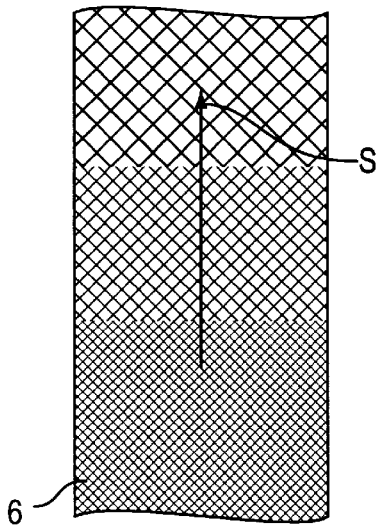
FIG. 7 illustrates a detailed view of a screen belt.

FIG. 7 shows the portion of a screen 6 that may be utilized for carrying out the process of the present invention, however, this depiction is somewhat exaggerated for the sake of explanation and clarity. Screen 6, as depicted in FIG. 7, is utilized for stationary mounting, i.e., exhibits substantially no translational movement. Screen 6 includes a plurality of zones, each zone including a different mesh width or texture. For example, the screen mesh width or texture becomes larger when viewed in the flow direction of the suspension.

Figure 8:
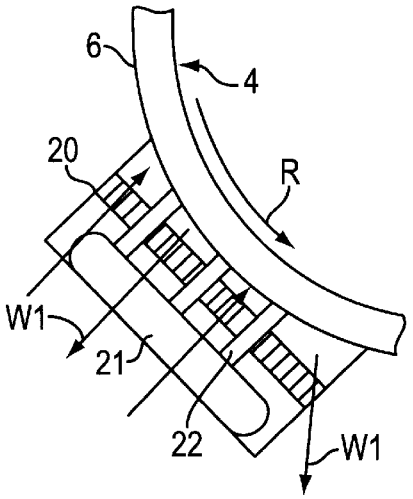
FIG. 8 illustrates a detailed view of a press device.

The draining effect may be further increased or enhanced by utilizing a special press device 20, as illustrated in FIG. 8. Press device 20 may include a pressure element 21, e.g., an air tube, for pressing rails 22 against, e.g., a substantially stationary flexible screen 6. Press device 20 may be designed such that, between the rails, chambers having different pressures may be formed or created by switching pressurization. For example, an overpressure may be formed via air pressure in a first chamber. In an adjacent second chamber, a partial vacuum may be formed to suction off water or moisture. In a next adjacent third chamber, another overpressure, etc. through press device 20. As an alternative/enhancement to this embodiment, rinse water may be utilized to create or form the over-pressure. In this manner, a particular rinsing effect may further be produced. However, this rinsing effect will accordingly reduce the draining capacity of the machine. Further, pressure element 21 may create or generate pressure pulses to further improve the draining capacity.

Figure 9:
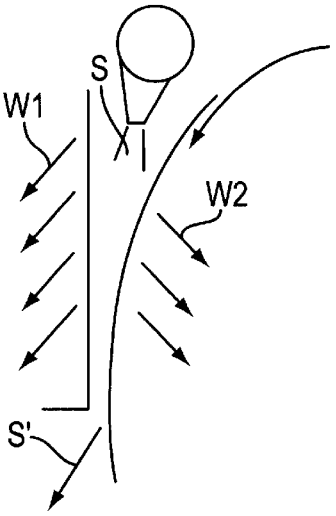
FIG. 9 illustrates a detailed view of a flat draining surface.

In principle, the process of the present invention may be performed if at least one of the converging surfaces is arched. As illustrated in FIG. 9, an arched surface, which is generally the surface that is driven to move, interacts with a flat surface to provide the above-discussed two-sided draining.

Figure 10:
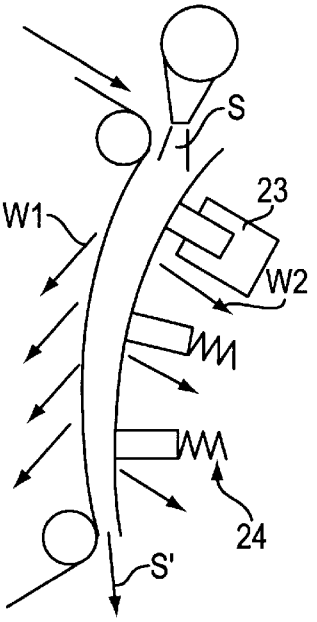
FIG. 10 illustrates a detailed view of a draining surface with press rails.

In a manner similar to FIG. 8, FIG. 10 illustrates a draining area that utilizes pressure rails 24. Pressure rails 24 may be pressed, e.g., with springs, against an interior of a permeable surface of the inner arched surface. It is noted that this additional pressure may further enhance the draining. Due to wear considerations, pressure rails 24 are preferably utilized in conjunction with the substantially stationary screen or the screen which is driven to move at the creeping speed. Further, or alternatively, pulsating pressure devices 23 may be utilized with, or instead of, pressure rails 24, which exhibit a constant pressure force. Use of pulsating pressure devices 23 will increase the draining capacity of the machine and further, help prevent the pulp from sticking to the arched surface.

Figure 11:
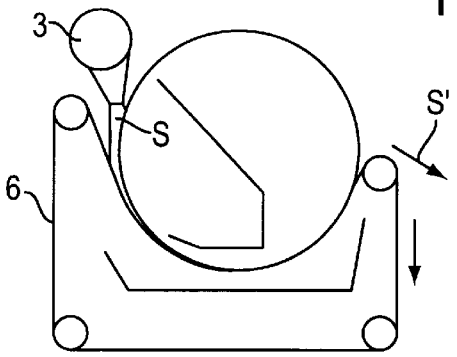
FIG. 11 illustrates a detailed view of a draining device with an exterior screen positioned on the bottom.

FIG. 11 shows a device similar to that depicted in FIG. 2, however, this embodiment has be substantially rotated 90°. In this manner, the draining area may be located, e.g., below the cylinders, thus additionally utilizing gravity in draining the suspension.

In accordance with the present invention, it may be advantageous to form both converging surfaces with flexible screens. In principle, this arrangement is utilized in double-screen molding devices in paper machines, however, these devices do not exhibit any significant relative translational speeds. As clearly indicated above, the relative rotational movement, in combination with the other discussed features of the draining device, significantly improves the final dryness of the thickened suspension.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A process to drain a fibrous pulp suspension comprising;

positioning two surfaces to converge in a downstream direction, one of the two surfaces having an outer sleeve with openings, the other of the two surfaces comprising a screen fixedly positioned around at least a portion of the outer sleeve, the screen and the openings forming drains for draining fluid from the pulp suspension;

feeding the fibrous pulp suspension between the two converging surfaces;

driving the one of the two converging surfaces to move the suspension with a relative translational velocity; and draining the fibrous pulp suspension through each of the two surfaces.

2. The process in accordance with claim 1, the feeding comprising:

distributing the fibrous pulp suspension in a wide stream between the two converging surfaces at a velocity that substantially corresponds to a velocity of the at least one driven converging surface.

3. The process in accordance with claim 1, further comprising exerting a pressure of at least approximately 0.01 bar on the suspension, due to screen tension, when located between the converging surfaces.

4. The process in accordance with claim 1, wherein the relative translational velocity is at least approximately 18 m/min.

5. The process in accordance with claim 1, wherein the relative translational velocity is at least approximately 50 m/min.

6. The process in accordance with claim 1, wherein one of the converging surfaces is smooth and the other converging surface includes a surface that increases in abrasion force in the downstream direction.

7. The process in accordance with claim 1, further comprising oscillating at least a portion of the two converging surfaces relative to each other.

8. The process in accordance with claim 7, further comprising oscillating the two converging surfaces relative to each other at a plurality of locations.

9. The process in accordance with claim 1, wherein one of the two converging surfaces is an outer arched surface and the other of the two converging surfaces is an inner arched surface.

10. The process according to claim 1, said one of said two surfaces comprising a drivable, pivotable, and rotatable cylinder.

11. The process according, to claim 1, said one of said two surfaces being arcuate.

12. The process according to claim 1, said two surfaces being arcuate.

* * * * *